US008475237B2

(12) United States Patent
Meynen

(10) Patent No.: US 8,475,237 B2
(45) Date of Patent: Jul. 2, 2013

(54) OPTICAL GRADE SURFACING TOOL

(75) Inventor: Mathieu Meynen, Charenton-le-Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 344 days.

(21) Appl. No.: 13/057,516

(22) PCT Filed: Sep. 1, 2009

(86) PCT No.: PCT/FR2009/051651

§ 371 (c)(1),
(2), (4) Date: Feb. 4, 2011

(87) PCT Pub. No.: WO2010/029245

PCT Pub. Date: Mar. 18, 2010

(65) Prior Publication Data

US 2011/0136416 A1 Jun. 9, 2011

(30) Foreign Application Priority Data

Sep. 10, 2008 (FR) ..... 08 56075

(51) Int. Cl.
*B24D 13/14* (2006.01)

(52) U.S. Cl.
USPC ..... 451/520; 451/539

(58) Field of Classification Search
USPC ..... 451/520, 490, 499, 500, 501, 359, 451/538, 539
See application file for complete search history.

(56) References Cited

U.S. PATENT DOCUMENTS

| | | | | |
|---|---|---|---|---|
| 391,581 | A * | 10/1888 | Carver | 451/490 |
| 610,762 | A * | 9/1898 | Keavy | 451/490 |
| 7,618,306 | B2 * | 11/2009 | Felipe et al. | 451/28 |
| 2005/0101235 | A1 | 5/2005 | Huguet | |
| 2006/0154581 | A1 | 7/2006 | Bernard et al. | |
| 2008/0171502 | A1 | 7/2008 | Stephane et al. | |

FOREIGN PATENT DOCUMENTS

| | | | |
|---|---|---|---|
| FR | 2834662 | A1 | 7/2003 |
| FR | 2857610 | A1 | 1/2005 |
| FR | 2900356 | A1 | 11/2007 |
| WO | 2007128894 | A1 | 11/2007 |

OTHER PUBLICATIONS

International Search Report, dated Dec. 10, 2009, from corresponding PCT application.

* cited by examiner

*Primary Examiner* — Robert Rose
(74) *Attorney, Agent, or Firm* — Young & Thompson

(57) ABSTRACT

An optical-grade surfacing tool includes: a rigid holder (60); an elastically compressible interface (12) secured to the rigid holder (60); and a flexible pad (13) that can be applied against a surface to be machined (71) and secured to the interface (12) opposite the rigid holder (60). The pad (13) is carried by an elastically extensible membrane (14) including: a central plate (15); and a plurality of straps (18) each radially protruding from the periphery of the plate (15) and each having a distal portion engaged with a fastening element (38), each strap (18) rotating about the side surface (28) of the interface (12) and extending up to the fastening element, each strap (18) being taut.

16 Claims, 2 Drawing Sheets

OPTICAL GRADE SURFACING TOOL

FIELD OF THE INVENTION

The invention relates to optical grade surfacing, for surfaces such as a face of an ophthalmic lens, a camera lens, an instrument for observing distant objects or a semiconductor substrate.

Surfacing means any operation aiming to modify the state of a previously worked surface. It is a question in particular of polishing, grinding or fine grinding operations aiming to modify (reduce or increase) the roughness of the surface and/or to reduce undulation thereof.

TECHNOLOGICAL BACKGROUND

There is already known, in particular from French patent application 2 834 662, to which corresponds US patent application 2005/0101235, French patent application 2 857 610, to which corresponds US patent application 2006/0154581, and French patent application 2 900 356, to which corresponds international application WO 2007/128894, a tool for surfacing an optical surface, the tool including: a rigid support having a transverse end surface; an elastically compressible interface attached to the rigid support, including a central part that is in line with to said end surface of the rigid support and a peripheral part that is transversely beyond said end surface of the rigid support, having a first transverse end surface, a second transverse end surface and a lateral surface extending from the periphery of the first end surface to the periphery of the second end surface, said first end surface being pressed against and covering said end surface of the rigid support; and a flexible pad adapted to be pressed against a surface to be worked, attached to the interface on the opposite side to the rigid support, including a central part that is in line with said end surface of the rigid support and a peripheral part that is transversely beyond said end surface of the rigid support.

To reduce the roughness of the optical surface, the tool is brought into contact with the optical surface and a sufficient pressure of the tool is maintained on it so that, by deformation of the interface, the pad espouses the shape of the optical surface.

While spraying the optical surface with a fluid, it is driven in rotation relative to the tool (or vice-versa) and is swept by the tool.

The optical surface is generally driven in rotation, friction between it and the tool being sufficient to entrain the tool so that it rotates with it.

The surfacing operation necessitates an abrasive that can be contained in the pad or in the fluid.

During surfacing, the interface, which is elastically compressible, compensates the curvature difference between the end surface of the tool support and the optical surface.

The results achieved by these tools are generally satisfactory, but it is sometimes difficult to avoid certain defects of appearance, namely the orange skin effect and the sheeplike effect.

To remedy these appearance defects, a flexible pad having a diameter larger than that of the interface so that the pad has an annular portion projecting transversely beyond the interface has already been proposed.

The resulting tool achieves an improvement in surface appearance, but in some circumstances such appearance defects remain.

OBJECT OF THE INVENTION

The invention aims to provide a surfacing tool of particularly high performance in terms of minimizing appearance defects, in particular but not exclusively for surfaces to be worked that are concave.

To this end it proposes an optical grade surfacing tool including: a rigid support having a transverse end surface; an elastically compressible interface attached to the rigid support, including a central part that is in line with said end surface of the rigid support and a peripheral part that is transversely beyond said end surface of the rigid support, having a first transverse end surface, a second transverse end surface and a lateral surface extending from the periphery of the first end surface to the periphery of the second end surface, said first end surface being pressed against and covering said end surface of the rigid support; and a flexible pad adapted to be pressed against a surface to be worked, attached to the interface on the opposite side to the rigid support, including a central part that is in line with said end surface of the rigid support and a peripheral part that is transversely beyond said end surface of the rigid support; characterized in that said pad is carried by an elastically stretchy membrane, said membrane including:

- a central plateau having a first transverse end surface to which said pad is stuck and a second transverse end surface pressed against and covering said second transverse end surface of said interface; and
- a plurality of straps each projecting radially from the periphery of said plateau and each having a distal part interengaged with an attachment means situated in line with the first end surface of the interface, each of said straps passing around said lateral surface of the interface and then extending as far as said attachment means, each strap being taut.

The membrane of the tool of the invention both keeps the pad taut and surrounds the periphery of the interface.

This enables the tool of the invention to offer particularly high performance, notably in terms of maintaining contact with the surface to be worked, including when the latter has strong variations of altitude, for example when it is one face of a spectacle lens for correcting the vision of a wearer suffering from presbyopia, myopia and astigmatism.

Thanks to its performance in terms of maintaining contact with the surface to be worked, the tool of the invention makes it possible to obtain a particularly high quality of surfacing, in particular but not exclusively for concave surfaces.

According to preferred features of implementing the membrane of the tool of the invention:

- an opening is formed in the distal part of each of said straps in order to engage that distal part over a projecting element forming said attachment means;
- said opening is oblong;
- said projecting element is part of said rigid support;
- said projecting element is part of a flange around said rigid support;
- said central plateau and said straps of said membrane are made in one piece; and/or
- the second end surface of said central plateau is stuck to said second end surface of said interface.

According to other features preferred because of the increased performance that they provide:

- the tool further includes a deformable ring disposed between said peripheral part of the interface and said straps;
- said rigid support is part of a base including a flexible collar around said support, said elastically compressible interface being pressed against and covering an end surface of said collar located on the same side as said end surface; and/or said base includes a rigid core having a transverse end surface and a flexible backing plate pressed against and covering said end surface, said rigid support being formed by said rigid core and a central part of said backing plate located in line with said transverse end surface of the core, said collar being formed by a peripheral part of said backing plate extending transversely beyond said end surface of said rigid core.

BRIEF DESCRIPTION OF THE DRAWINGS

The description of the invention continues now with the detailed description of embodiments of the invention given hereinafter by way of nonlimiting illustration and with reference to the appended drawings. In the drawings.

DETAILED DESCRIPTION OF EMBODIMENTS

Figure 1:
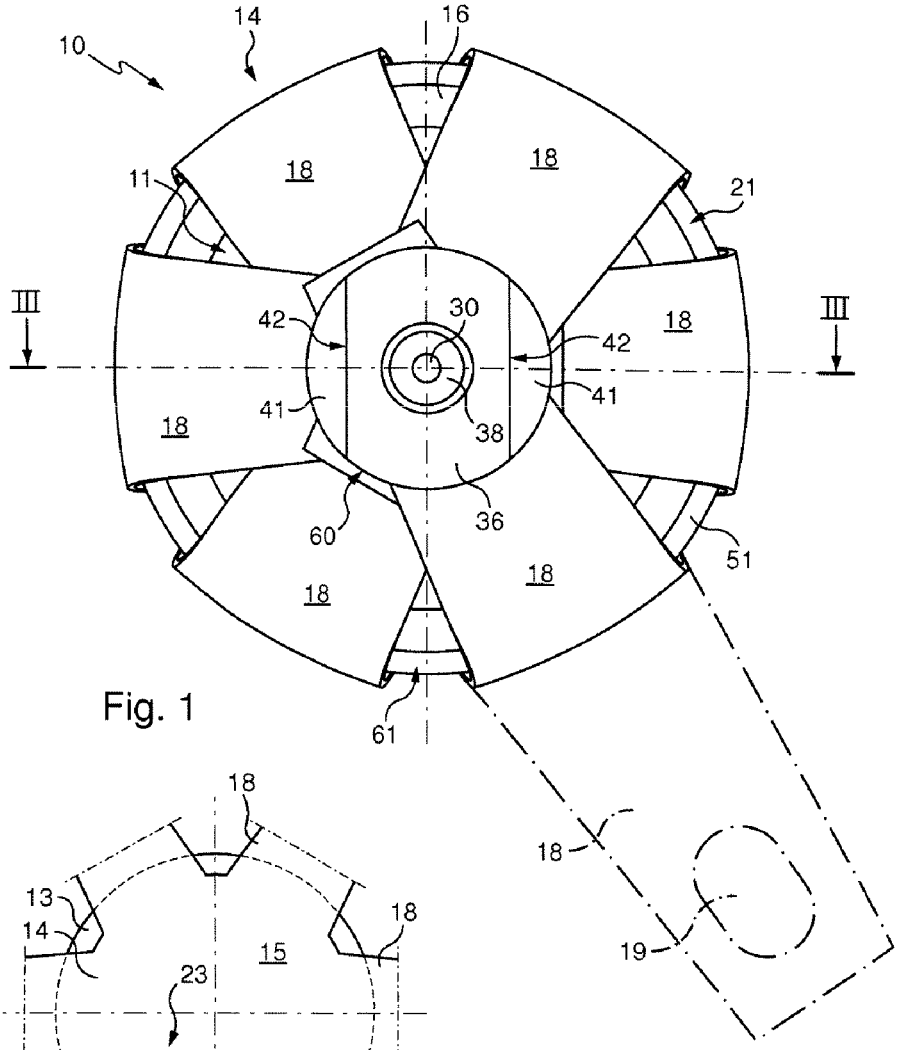
FIG. 1 is a plan view of a surfacing tool of the invention.

The tool 10 shown in the drawings includes a base 11, an elastically compressible interface 12 attached to the base 11, a flexible pad 13 attached to the interface 12 on the opposite side to the base 11, a membrane 14 for tensioning the pad 13 and a deformable ring 16 disposed between the peripheral part of the interface 12 and the straps 18 of the membrane 14.

With the exception of the membrane 14, the general shape of the tool 10 is that of a circular cylinder and the tool has an axis X of symmetry that defines a longitudinal direction.

The base 11 includes a rigid core 20 and a flexible backing plate 21. On the side seen at the bottom in FIG. 3, the base 11 has a transverse end surface 25.

Figure 3:
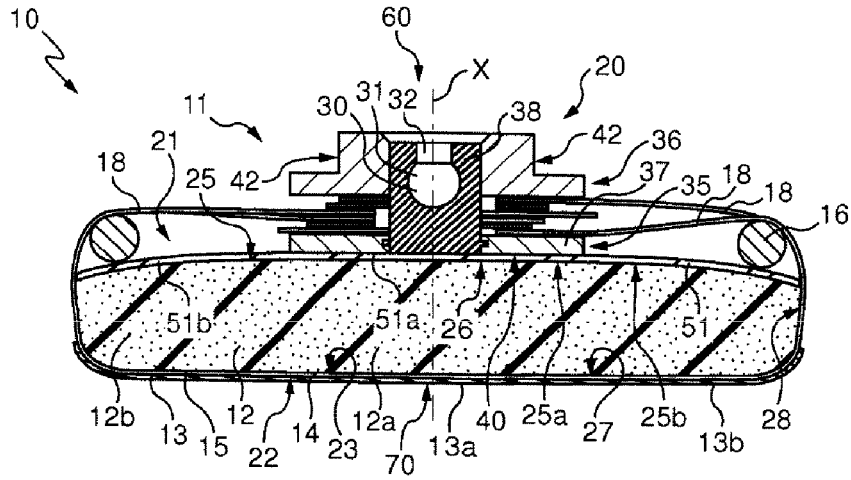
FIG. 3 is a view in section taken along the line III-III in FIG. 1.

In the absence of stress, i.e. in a position that is not represented because the tensioning membrane 14 acts on the backing plate 21 including in the rest position shown in FIGS. 1 and 3, the end surface 25 is plane.

The interface 12 has a first end surface 26, a second end surface 27 and a lateral surface 28 extending from the periphery of the surface 26 to the periphery of the surface 27.

In the absence of stress, i.e. in a position that is not shown, as explained above, the interface 12 has the general shape of a disk.

By the surface 26, the interface 12 is pressed against and covers the surface 25 of the base 11.

The attachment of the base 11 and the interface 12 to each other is effected here by sticking them together over the whole of the surfaces 25 and 26.

The base 11 includes a cavity 30 opening onto the opposite side to the end surface 25 and extending in the longitudinal direction partway through the thickness of the base 11.

The cavity 30 is disposed centrally and is adapted for mounting the tool 10 on the head of the spindle of a surfacing machine.

The cavity 30 has a part-spherical portion 31 with the overall shape of three quarters of a sphere and a cylindrical portion 32 extending between the portion 31 and the opening of the cavity 30.

The spindle head adapted to be received into the cavity 30 includes a part-spherical end conformed like the portion 31 and a cylindrical portion of smaller diameter than the portion 32.

The base 11 and the spindle of the machine simply clip together, the material around the cylindrical portion 31 being deformable so that the spherical part of the head of the spindle can be housed in the portion 32.

When the spindle head is engaged in the cavity 30, the tool 10 cooperates with the spindle in the manner of a ball joint.

The cavity 30 is produced in the rigid core 20, which is described in more detail next.

The core 20 includes a body 35 and a head 36.

Figure 2:
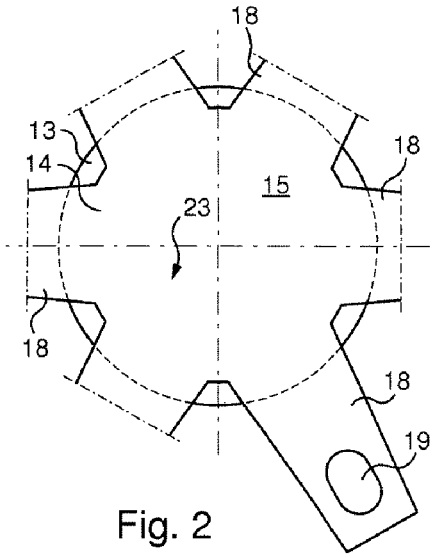
FIG. 2 is a top view of the combination of the tensioning membrane and the pad, shown flat.

The body 35 includes an annular flange 37 and a threaded stud 38 projecting from the flange 37 on the side seen at the top in FIG. 2, the stud 38 being at the center of the flange 37.

The cavity 30 is produced in the stud 38.

The end surface 40 of the body 35 that is seen at the bottom in FIG. 3 is flat and continuous, the respective end surfaces of the flange 37 and the stud 38 being flush with each other.

Here the flange 37 is in practice of metal, for example steel, and the stud 38 is in practice of relatively rigid plastic material molded onto the flange 37. The stiffness of the stud 38 is chosen so that it cannot be deformed at the level of the surface 40 but can be deformed at the level of the cylindrical portion 32 to enable clipping of the spindle head into the cavity 30.

On its external lateral surface projecting from the flange 37, the stud 38 has a thread enabling it to cooperate with the threaded bore at the center of the head 36, which cooperates with the body 35 in the manner of a nut.

Here the head 36 has in practice a generally annular shape with the same outside diameter as the flange 37 and with two lateral cutaway portions 41 to expose two parallel flat faces 42 parallel to the axial or longitudinal direction X in order to enable the head 36 to be tightened and loosened relative to the flange 37 using a conventional wrench designed for turning nuts.

Here the backing plate 21 is formed by a flexible disk 51.

In the absence of stress the disk 51 is generally circular with a diameter similar to that of the interface 12.

The disk 51 is concentric with the remainder of the tool, and in particular concentric with the interface 12 and the core 20.

Here the disk 51 has a thickness similar to that of the membrane 14.

The disk 51 is attached to the core 20 by sticking its transverse end surface, seen at the top in FIG. 3, to the whole of the surface 40.

The transverse end surface of the disk 51 seen at the bottom in FIG. 3 forms the transverse end surface 25 of the base 11.

Given the stiffness of the end surface 40 of the core 20 and the incompressibility of the disk 51 in the axial or longitudinal direction X, or in any event its very low compressibility compared to the compressibility of the interface 12, the central portion 51*a* of the disk 51 located in line with the end surface 40 can be considered rigid because it cannot bend like the peripheral portion 51*b* which is transversely beyond the surface 40.

Thus the base 11 includes:

a rigid support 60 formed by the core 20 and the central part 51*a* of the disk 51, this rigid support having a transverse end surface corresponding to the central part 25*a* of the surface 25 situated in line with the end surface 40; and a flexible collar 61 formed by the peripheral part 51*b* of the disk 51, this collar surrounding the rigid support 60, the elastically compressible interface 12 being pressed against and covering the end surface 25*b* of the collar 61 and the end surface 25*a* of the rigid support 60.

It will be noted that the elastically compressible interface 12 includes a central part 12*a* that is in line with the transverse end surface 40 or 25*a* and a peripheral part 12*b* that is transversely beyond the transverse end surface 40 or 25*a*.

In the absence of stress, the pad 13 has the general shape of a disk of slightly greater diameter than the interface 12. The thickness of the pad 13 is significantly less than the thickness of the interface 12.

The membrane 14 is produced in an elastically stretchy material significantly thinner than the interface 12.

As seen more particularly in FIG. 2, the membrane 14 includes a central plateau 15 and a plurality of identical straps 18, here six straps, projecting radially from the periphery of the plateau 15.

In FIG. 1, the membrane 14 is shown in bold line as when placed on the rest of the tool 10, while one of the straps 18 is shown in chain-dotted line as when flat. In FIG. 2, the pad 13 and the membrane 14 are shown as when flat.

In the absence of stress, the plateau 15 has the general shape of a disk of similar diameter to the interface 12.

The central plateau 15 has, on the side seen at the bottom in FIG. 3 (this side is not visible in FIG. 2), a transverse end surface 22 and, on the side that is seen at the top in FIG. 3 (this side is visible in FIG. 2), a transverse end surface 23.

Here the pad 13 is pressed against and covers the end surface 22 and is stuck to the membrane 14 over the whole of the surface 22.

On the side opposite the pad 13, the plateau 15 is pressed against and covers the end surface 27 of the interface 12. Here the plateau 15 is attached to the interface 12 by sticking its end surface 23 to the whole of the end surface 27 of the interface 12.

Each of the straps 18 has a distal part in which an opening 19 is formed, here an oblong opening.

Alternatively, the openings 19 are conformed differently, for example being circular.

Here the straps 18 have the shape of a band the width of which is greater at the central plateau 15 end than at the distal portion end, the width decreasing regularly over the length of the straps.

Here the central plateau 15 and the straps 18 are made in one piece from a disk of material from which the initial gaps between the straps have been cut out.

In the tool 10, each of the straps 18 turns around the lateral surface 28 of the interface 12 and around the deformable ring 16 and then extends as far as the pin 38 that is engaged in the opening 19, the pin 38 thus forming means for attaching the distal part of each strap 18 in line with the end surface 26 of the interface 12.

The respective distal parts of the straps 18 are stacked and gripped between the body 35 and the head 36 of the core 20.

When it is interengaged in this way with the pin 38, each of the straps 18 is taut, its arrangement being determined accordingly, in particular the location of the opening 19.

Fitting the straps 18 to the pin 38 thus tensions the central plateau 15 of the membrane 14 and thus tensions the pad 13 that is stuck to the plateau 15.

This tensioning enables the pad 13 to work under improved conditions and in particular eliminates or greatly reduces the risk of creases appearing on the pad 13 during surfacing.

Thanks to the plateau 15 of the membrane 14, the pad 13 also benefits from increased strength, which makes it possible to use an especially thin pad 13.

The arrangement of the straps 18 is such here that, because of the effect of the tensioning produced by the straps 18, the interface 12 adopts a conformation in which its peripheral part 12*b* is raised so that the surface 70 of the pad 13 intended to come into contact with the surface to be worked is slightly convex.

It will be noted that tensioning the pad 13 by means of the membrane 14 has the benefit of making possible easy adjustment of the tension, simply by varying the location of the opening 19 in the straps 18, thus offering excellent repeatability from one tool to another.

It will also be noted that it is possible to provide a plurality of orifices like the orifice 19 on the straps 18 in order, with the same membrane such as the membrane 14, to offer a plurality of tensions in the pad such as the pad 13.

It will further be noted that surrounding the lateral surface 28 of the interface 12 with the straps 18 provides a belting effect that is favorable to the behavior of the tool 10 during deformations, in particular because it opposes shearing of the interface 12 at its periphery.

Figure 4:
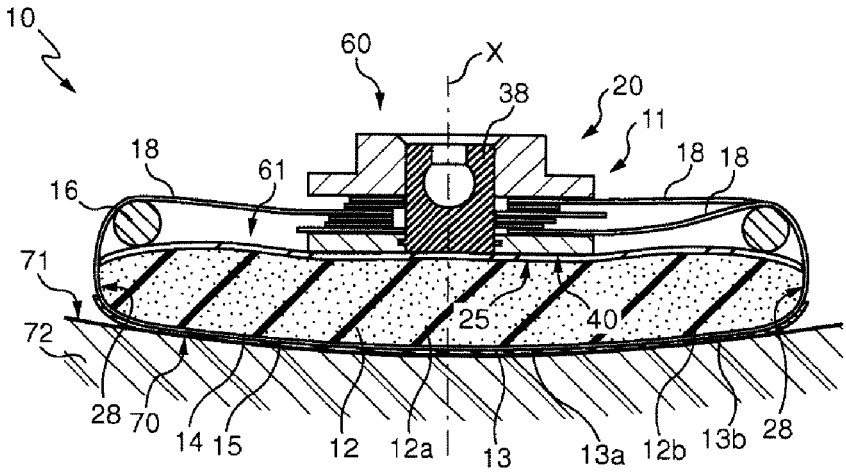
FIG. 4 is a view similar to FIG. 3, showing how the tool is deformed in contact with a concave surface to be worked.

When the tool 10 is pressed against a concave surface to be worked, such as the surface 71 shown in FIG. 4, the elastically compressible interface 12 is deformed to allow the surface 70 to espouse the surface 71.

It is seen that the interface 12 is strongly compressed in the central part 12*a*.

To effect surfacing, the lens 72 of which the surface 71 is part is mounted on a rotary support (not shown) and the tool 10 is pressed against the surface 71 with sufficient force for the pad 13 to espouse its shape.

Here the tool 10 is free to rotate while however being off-center relative to the optical surface 71.

The friction between the surface 71 to be worked and the pad 13 is sufficient to entrain the tool 10 in rotation about the axis X of symmetry and in the same direction as the lens 72.

The optical surface 71 is sprayed with a spray fluid that is either non-abrasive or abrasive according to whether the pad 13 exercises this function itself or not.

In order to sweep the whole of the optical surface 71, the tool 10 is moved during surfacing along a radial trajectory, the point of intersection of the axis X of the tool 10 with the optical surface 71 effecting a to-and-fro movement between two return points.

During surfacing, the fact that the membrane 14 offers both tensioning of the pad 13 and belting of the periphery of the interface 12 means that the tool offers particularly good performance in terms of remaining in contact with the surface 71 to be worked, including when the latter surface features large variations in altitude, for example if it is one face of an eyeglass lens for correcting the vision of a wearer suffering from presbyopia, myopia and astigmatism.

The beneficial effect of belting the peripheral portion of the interface 12 by means of the straps 18, notably in respect of the uniformity of the pressure exerted on the surface to be worked such as the surface 71, is reinforced by the presence of the deformable ring 16, which itself, because it is continuous, also achieves some uniformization of the forces.

It will be noted that the presence of the collar 61 is also favorable to uniform distribution of the pressure exerted on the surface to be worked.

Figure 5:
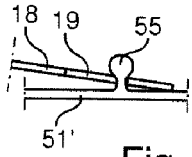
FIG. 5 is a partial view in section showing a variant of strap attachment means.

FIG. 5 shows a variant of the tool 10 in which the attachment means providing a grip on the distal parts of the straps 18 are not formed by the pin 38 of the core 20 but by studs projecting from the collar 61.

In this variant, the disk 51 is replaced by a disk 51' having in an intermediate position between the core 20 and the ring 16 a domed head stud 55 projecting from the side that is seen on the top in FIG. 3, i.e. the side opposite the interface 12.

In this variant, the straps 18 are shorter so that they can produce the required tension by engagement of their opening 19 over the corresponding stud 55.

Here the disk 51' and the stud 55 are molded in one piece, but it is of course possible to attach the stud 55 or the like by gluing or by any other fixing means.

In variants that are not shown, the attachment means of the straps such as the straps 18, while remaining in line with the end surface 26 of the interface 12, are different from the pin 38 and the studs 55, for example, for some straps at least, a portion of the spindle on which the tool is mounted; studs similar to the studs 55 arranged at the periphery of a core such as the core 20 or a rigid support such as the support 60; or attachment means that are not part of a core or rigid support, for example hooks at locations similar to those of the studs 55.

In the tool 10, the attachment between the assembly formed by the pad 13 and the membrane 14 and the rest of the tool involves sticking the central plateau 15 to the interface 12. This prevents the plateau 15 slipping relative to the interface 12.

Alternatively, in configurations in which the risk of slipping is low, the attachment between the assembly formed by the pad such as the pad 13 and the membrane such as the membrane 14 is effected only by the straps such as the strap 18.

In some circumstances it is also possible to effect the attachment of the core such as the core 20 or the rigid support such as the support 60 to the rest of the tool only by the straps such as the strap 18.

In the tool 10 shown, the diameter of the pad 13 is stuck than the diameter of the plateau 15. Alternatively, the diameter of the pad 13 is different, for example identical to or even slightly less than the diameter of the plateau 15.

In the tool 10 shown, the pad 13 is stuck directly to the plateau 15. Alternatively, an intermediate disk is disposed between the pad 13 and the plateau 15.

In a variant of the tool 10 that is not shown, adapted to work a surface of more pronounced concavity than the surface 71, the end surface like the end surface 40 or 25*a* is not flat but instead convex and/or the interface like the interface 12 has an initial conformation curved in corresponding fashion and is of uniform thickness.

In other variants that are not shown, the disk 51 has a thickness significantly different from that of the membrane 14; a supplementary disk, of smaller diameter than the disk 51 and of greater diameter than the flange 37, is disposed between the flange 37 and the disk 51; the rigid support 60 and the collar 61 are replaced by a rigid support and a collar arranged differently, for example as described in French patent application 2 900 356, to which international application WO 2007/128894 corresponds, or there is no such collar.

Numerous other variants are possible as a function of circumstances and in this respect it is pointed out that the invention is not limited to the examples described and shown.

The invention claimed is:

1. Optical grade surfacing tool, including: a rigid support (60) having a transverse end surface (25*a*); an elastically compressible interface (12) attached to the rigid support (60), including a central part (12*a*) which is in line with said end surface (25*a*) of the rigid support (60) and a peripheral part (12*b*) that is transversely beyond said end surface (25*a*) of the rigid support (60), having a first transverse end surface (26), a second transverse end surface (27) and a lateral surface (28) extending from the periphery of the first end surface (26) to the periphery of the second end surface (27), said first end surface (26) being pressed against and covering said end surface (25*a*) of the rigid support (60); and a flexible pad (13) adapted to be pressed against a surface (71) to be worked, attached to the interface (12) on the opposite side to the rigid support (60), including a central part (13*a*) that is in line with said end surface (25*a*) of the rigid support and a peripheral part (13*b*) that is transversely beyond said end surface (25*a*) of the rigid support; characterized in that said pad (13) is carried by an elastically stretchy membrane (14), said membrane including:

a central plateau (15) having a first transverse end surface (22) to which said pad (13) is stuck and a second transverse end surface (23) pressed against and covering said second transverse end surface (27) of said interface (12); and a plurality of straps (18) each projecting radially from the periphery of said plateau (15) and each having a distal part interengaged with an attachment means (38; 55) situated in line with the first end surface (26) of the interface (12), each of said straps (18) passing around said lateral surface (28) of the interface (12) and then extending as far as said attachment means, each strap (18) being taut.

2. Tool according to claim 1, characterized in that an opening (19) is formed in the distal part of each of said straps (18) in order to engage that distal part over a projecting element (38; 55) forming said attachment means.

3. Tool according to claim 2, characterized in that said opening (19) is oblong.

4. Tool according to claim 2, characterized in that said projecting element (38) is part of said rigid support (60).

5. Tool according to claim 2, characterized in that said projecting element (55) is part of a flange (61) around said rigid support (60).

6. Tool according to claim 1, characterized in that said central plateau (15) and said straps (18) of said membrane (14) are made in one piece.

7. Tool according to claim 1, characterized in that the second end surface (23) of said central plateau (15) is stuck to said second end surface (27) of said interface (12).

8. Tool according to claim 1, characterized in that it further includes a deformable ring (16) disposed between said peripheral part (12*b*) of the interface (12) and said straps (18).

9. Tool according to claim 1, characterized in that said rigid support (60) is part of a base (11) including a flexible collar (61) around said support, said elastically compressible interface (12) being pressed against and covering an end surface (25*b*) of said collar (61) located on the same side as said end surface (25*a*).

10. Tool according to claim 9, characterized in that said base (11) includes a rigid core (20) having a transverse end surface (40) and a flexible backing plate (21) pressed against and covering said end surface (40), said rigid support (60) being formed by said rigid core (20) and a central part of said backing plate (21) located in line with said transverse end surface (40) of the core (20), said collar (61) being formed by a peripheral part (51*b*) of said backing plate (21) extending transversely beyond said end surface (40) of said rigid core (20).

11. Tool according to claim 3, characterized in that said projecting element (38) is part of said rigid support (60).

12. Tool according to claim 3, characterized in that said projecting element (55) is part of a flange (61) around said rigid support (60).

13. Tool according to claim 2, characterized in that said central plateau (15) and said straps (18) of said membrane (14) are made in one piece.

14. Tool according to claim 2, characterized in that the second end surface (23) of said central plateau (15) is stuck to said second end surface (27) of said interface (12).

15. Tool according to claim 2, characterized in that it further includes a deformable ring (16) disposed between said peripheral part (12*b*) of the interface (12) and said straps (18).

16. Tool according to claim 2, characterized in that said rigid support (60) is part of a base (11) including a flexible collar (61) around said support, said elastically compressible interface (12) being pressed against and covering an end surface (25*b*) of said collar (61) located on the same side as said end surface (25*a*).

* * * * *